US009551548B2

(12) United States Patent
Sierra Izquierdo

(10) Patent No.: US 9,551,548 B2
(45) Date of Patent: Jan. 24, 2017

(54) BARREL AND AN ELECTROMAGNETIC PROJECTILE LAUNCHING SYSTEM

(71) Applicant: Borja Sierra Izquierdo, Getxo (ES)

(72) Inventor: Borja Sierra Izquierdo, Getxo (ES)

( * ) Notice: Subject to any disclaimer, the term of this patent is extended or adjusted under 35 U.S.C. 154(b) by 463 days.

(21) Appl. No.: 14/228,845

(22) Filed: Mar. 28, 2014

(65) Prior Publication Data

US 2016/0290758 A1 Oct. 6, 2016

(51) Int. Cl.
*F41B 6/00* (2006.01)
*F42B 6/00* (2006.01)

(52) U.S. Cl.
CPC ..... *F41B 6/006* (2013.01); *F42B 6/006* (2013.01)

(58) Field of Classification Search
CPC ..... F41B 6/006
USPC ..... 124/3
See application file for complete search history.

(56) References Cited

U.S. PATENT DOCUMENTS 2,870,675 A * 1/1959 Salisbury ..... F41B 6/00 124/3
4,343,223 A * 8/1982 Hawke ..... H05H 1/54 124/3
4,677,895 A * 7/1987 Carlson ..... F41B 6/006 124/3
4,733,595 A * 3/1988 Oberly ..... F41B 6/006 124/3
4,813,332 A * 3/1989 Jasper, Jr. ..... F41B 6/006 138/103
4,858,512 A * 8/1989 Jasper, Jr. ..... F41B 6/006 124/3
5,237,904 A * 8/1993 Kuhlmann-Wilsdorf F41B 6/006 102/517
6,696,775 B2 * 2/2004 Engel ..... H02K 41/0352 124/3
6,725,759 B1 * 4/2004 Kathe ..... F41B 6/00 124/3
8,302,584 B1 * 11/2012 Lu ..... F41B 6/003 124/3
2004/0255767 A1 * 12/2004 Frasca ..... F41B 6/00 89/8
2005/0155487 A1 * 7/2005 Frasca ..... F41B 6/00 89/8
2007/0277668 A1 * 12/2007 Frasca ..... F41B 6/00 89/8

(Continued)

OTHER PUBLICATIONS

James Gaier | Clarence Gooden | Doreen Yashan | Steve Naud, "Feasibility of Intercalated Graphite Railgun Armatures", Apr. 2-5, 1990, NASA Technical Memorandum 102546 [All Pages].*

*Primary Examiner* — Samir Abdosh
(74) *Attorney, Agent, or Firm* — Lucas & Mercanti, LLP

(57) ABSTRACT

A multiple rails magnetic accelerator is presented. By means of an electric discharge, a magnetic field is created which moves an armature along the rails. These rails are made in such way they can stand multiple shoots without eroding. The launcher is configured such that the critical velocity of the armature increases along the axial direction towards the muzzle as it moves through the gun. The rails are separated with a proper electrical insulator and the whole structure can be surrounded by one or more shells to confine the barrel and apply compressive stress. The compressive stresses applied preload the rails and the composite barrel structure to resist overall forces encountered during projectile firing.

12 Claims, 6 Drawing Sheets

(56) References Cited

U.S. PATENT DOCUMENTS

2010/0194212 A1* 8/2010 Proulx ..... F41B 6/006
310/12.07

* cited by examiner

BARREL AND AN ELECTROMAGNETIC PROJECTILE LAUNCHING SYSTEM

FIELD OF INVENTION

The invention relates generally to electromagnetic launcher rails, and more particularly to such methods and configurations that preferably can improve durability and performance of rails for launching a projectile at high speed (in the order of 3-7 km/s) or hypervelocities (in the order of >10 km/s).

STATE OF THE ART

Electromagnetic rail guns (EMG) have attracted much attention for the last years; its applications fields include mining, military, hunting and sports guns, drone launching, transport, nuclear power stations and missile/rocket launching among others. But it is recently that their research has reached a mature state and industrial development starts.

Previous attempts have been made since 1921 (U.S. Pat. No. 1,985,254) along multiple approaches to the problems these type of inventions present. Mainly, these problems deal with the huge erosion the rails suffer, rendering the gun useless after just a few shots. Some proposals have directed the subject towards the use of super conductive magnets, but at the expense of needing an unpractical liquid nitrogen refrigerated gun for those purposes.

On the other hand, graphene is a carbon composite discovered in the decade of 1930 but whose interesting properties have not been researched till recently, receiving much attention after Dr Gueim and Dr Novosiólov's work won the Physics Nobel Prize in 2010. Among its main properties are: great flexibility, high electric conductivity, high elasticity and hardness, lower Joule effect, auto repair ability and the ability to dope it to change its magnetic properties. The magnetic and diamagnetic properties have been studied (M. Koshino and T. Ando, Physica E (2007), Y. Arimura and T. Ando, Journal of the Physical Society of Japan 81 (2012), M. Garnica, D. Stradi, S. Barja, F. Calleja, C. Diaz, M. Alcami, N. Martin, A. L. Vázquez de Parga, F. Martin and R. Miranda, Nature Physics 9 (2013)) and with the constant improvement of its fabrication, graphene can be an interesting proposal for electromagnetic guns. All the main characteristics mentioned above are of the greatest interest for an EMG, as they improve substantially the behavior of the barrel, while maintaining those properties offered by the traditional copper rails.

Lastly, in U.S. Pat. No. 5,078,042, Jensen supplies with figures the actual size of the magnetic shielding for projectiles used in EMG depending of the purpose, thickness can vary from 0.065 mm to 0.17 mm, remembering the user that the shielding also needs to cope with the structural rigidity for such velocities.

BRIEF DESCRIPTION OF THE INVENTION

An electromagnetic launcher utilizes electromagnetic force to propel an electrically conductive payload. Electrically conductive rails may be disposed in a longitudinal launch direction from breech to muzzle ends. Electric current flowing through the rails induces a magnetic field. This field produces a mutual repulsion force between the rails and accelerates the armature along the bore axis direction towards the muzzle. This invention will focus on the rail system, but those skilled in the art will know that different methods for firing the armature exist. The use of a pressurized gas, or a traditional propellant to start the motion of the armature, or just the electric discharge, are different approaches open to the firing of EMG systems and this invention is, in no way, closed to those different options. Moreover, different applications may need different pre-firing methods.

The invention relates generally to electromagnetic launcher rails, and more particularly to such configurations that preferably can improve durability and performance of rails for launching a projectile at high speed. Traditionally, copper rails have been used. Copper is a diamagnetic metal and an excellent electrical conductor and can withstand the pressure effects the gun suffers while firing. However, is possible to improve the overall capability of the gun. The rails do not only deal with the erosion due to the friction of the armature inside the barrel, but also with the one caused by the release of the electrical discharge; as this can create a plasma that erodes the rails as well as the armature. Some proposals have aimed to the fact that a graphite or tungsten composite layer can be used in order to reduce the erosion, however the use of graphene can be of much better purpose and is one of the aims of this invention to use a graphene layer over the copper rails to enhance the use of general electromagnetic launchers.

Is also an aim of the invention to provide another approach to this same problem with the use of diamagnetic graphene rails.

When a payload is fired with an EMG, the discharge of at least 500 KAmp (usually in the order of millions of volts) creates a plasma arc that penetrates into the armature for around 1 mm. It is the so called "skin effect", which also affects the main rails. The graphene, with its hardness in the order of that of the diamond and strength over the one of the steel, can act as a protector meanwhile it transmit the current among the rails to close the circuit.

With the elasticity and flexibility showed, the rails can be twisted in order to create a double spiral similar to de DNA structure. This can improve the behavior of the gun as it is well known in those versed in the art that a bigger length in the rails allows for a greater velocity; presented in a spiral, the contraction of the rails in the same space allows for a greater path. This property has another side effect, as a way of implementing proper rifling into the bore, a characteristic not well developed in previous works. Since the XV century is well known among gun manufacturers that rifling improves the stability and the reach of a payload. However, in the electromagnetic launchers is a fact seldom thought about. With the implement of twisted graphene rails, the grooves can be made coincidentally with the pitch of the rails and thus allow the payload to behave as an usual projectile, whose ballistic mathematics are well known.

The high electrical conductivity and the lack of a resistivity band in graphene are two characteristics that improve the way the armature is fired. The electrical current will suffer for smaller loses meanwhile it crosses from one rail to the armature and then to the other rail, improving the efficiency and consumption of electricity.

Heating effects are a traditional major concern in every gun, and EMGs are not an exception. Great quantities of heat are created when the discharge hits the rails and then the armature, as well as the friction generated by the movement of the payload among the barrel. With the joint behavior of the lower resistance and Joule effects, a faster cooling system can be attained, in such a way that multiple firing is possible without reducing the rate of fire.

The auto repair ability of graphene allows the layers to capture surrounding carbon atoms and add them to the net, covering the holes which appear. This ability can be crucial to improve the life of a barrel with its multi firing capability, as it will allow the barrel to heal itself meanwhile is not being used It is also an aim of this invention to provide a projectile enhancement with the use of graphene as a protective layer. As stated above, the presence of a current passing through the rails into the armature and then back to the opposite rails can produce an erosion on the materials used for the payload. With the use of graphene, the current can pass with ease, allowing for a better consumption of energy when firing.

The magnetic current created should not be a problem if the armature has inside any electronics if good shielding is provided. Discovered decades ago, magnetic shielding presents a low-reluctance path against magnetic fields, and it can deviate them for its original course to avoid interferences, concentrating or "trapping" it. For that reason, nickel-iron alloys can be used, as μ-Metal, Permalloy or Armco alloy. The first two materials provide maximum shielding at low flux densities; the last is best at higher flux densities. Cast iron and materials of relatively low permeability can also be used, but at the cost of using heavier thicknesses. If the magnetic field B is too big, various alternated layers of these alloys can be used as a defense in depth to avoid such interferences, each one eliminating part of the magnetic involved till none is left.

The deviation of this magnetic field can be used to spin the projectile inside the barrel if the layers are disposed in such a way that they can channel it in the proper direction. This will improve the stability and reach of the projectile, meanwhile avoiding the use of external coils to create the same effect, and can be added to the rifling to improve that desired spinning. For that purpose, the magnetic shielding should be arranged in such way around the chevron shaped part of the armature (could be spiral, for example) as well as in the back part of it. Different layers of shielding should be arranged in such a way that they add their effect to the overall effort.

BRIEF DESCRIPTION OF THE FIGURES

The accompanying drawings, which are incorporated into and form a part of the specifications, illustrate an embodiment of the present invention and, together with the description, serve to explain the principles of the invention. In the drawings.

DETAILED DESCRIPTION OF THE INVENTION

In connection with the figures, several examples of embodiments of the invention are further detailed. The examples are shown simply by a way of illustration and will be regarded not as restrictive of the invention scope.

The present invention is an electromagnetic projectile launching system which uses a plurality of conducting rails assembled in pairs, to accelerate conductive armatures.

Figure 1:
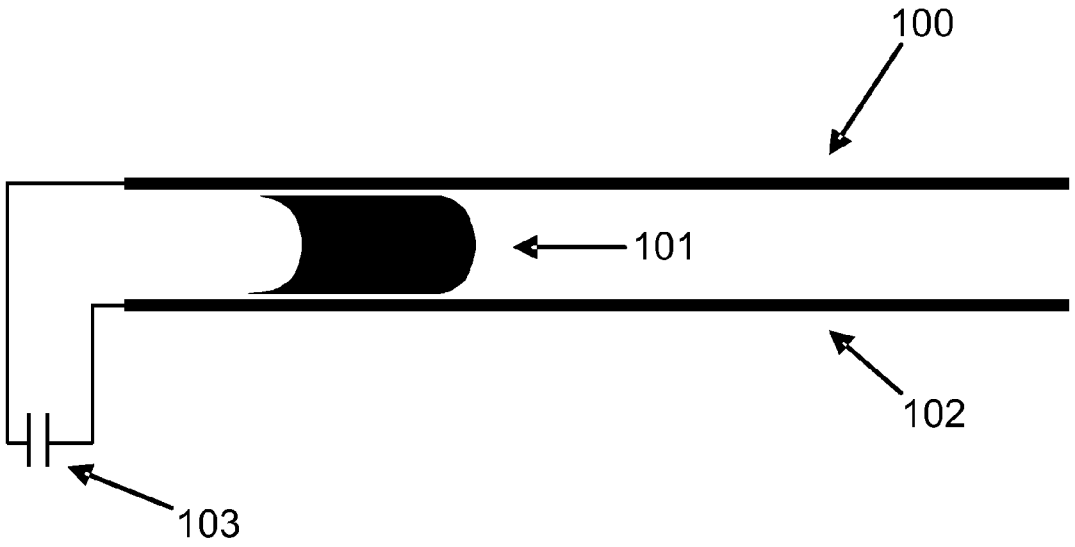
FIG. 1: It is a schematic representation of the invention with a single pair of rails.

FIG. 1 is a schematic illustration of an electromagnetic rail gun. The rail gun of FIG. 1 uses a positive rail 100, a sliding armature 101, and a negative rail 102. As illustrated in FIG. 1, a high current I from a generator (AC or DC) 103 enters the positive rail 100, and is conducted through the sliding armature 101 and negative rail 102 to produce a strong magnetic field which drives the sliding armature 101 forward. Those skilled in the art will know that a plurality of pairs 100-102 can be used with advantage, and here both will appear along the description. In that case, one or more generators 103 can be used to provide the desired amount of energy for the pairs of rails 100-102 used. If only one generator 103 is used, the current will be divided among all the pairs. If more than one generator 103 is used, then the current will go from each generator 103 to each pair of positive 100 and negative 102 rails.

Figure 2:
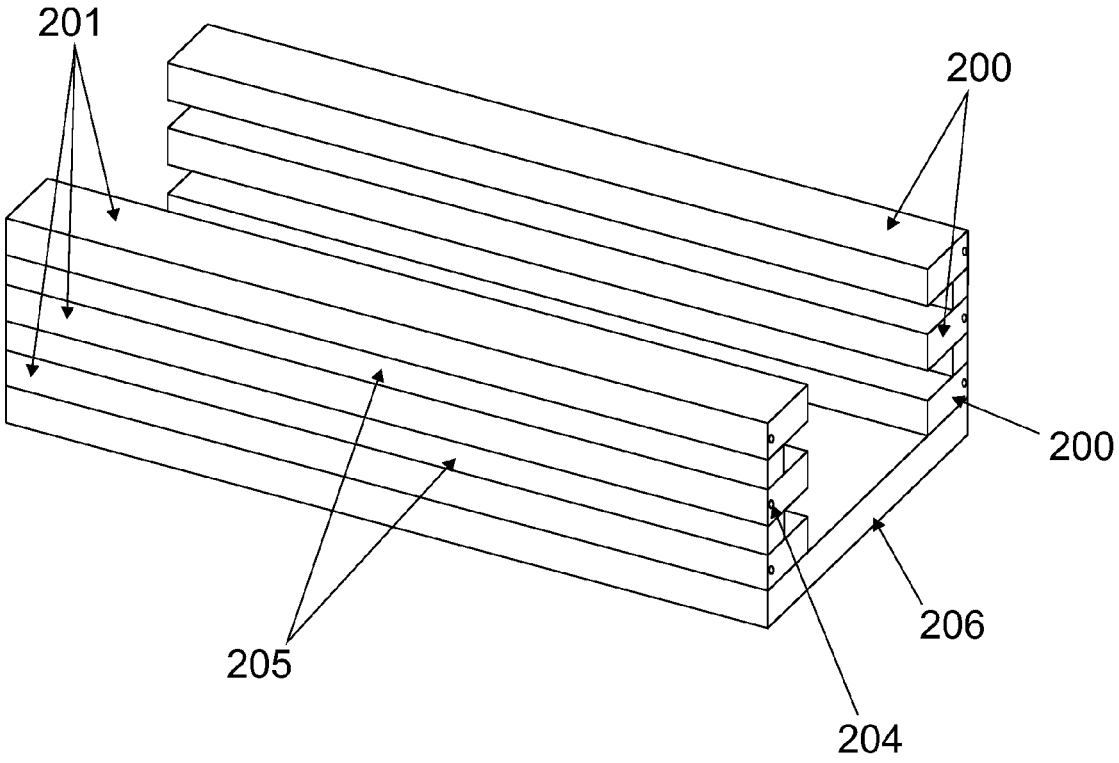
FIG. 2: It is an assembly of copper rails with graphene's protective layer in an open environment.

FIG. 2 is an assembly of open multiple copper rails with a graphene protective layer. Positive copper rails 200 receive the high current from one or more generators (not shown in FIG. 2) and conduct it towards the negative rails 201 through the armature (not shown in FIG. 2). Rails are covered on their armature exposed faces 203 with a layer of graphene. Both positive 200 and negative 201 copper rails have a cooling system 204 used to cool down the heat generated by the firing of the EMS. The rails 200-201 are isolated from each other by a compound 205 which can be fiberglass, S Glass, or other type of material able both to tolerate the pressures generated by the firing and to insulate them electrically. The structure is set in a structural framework 206 of which only the bottom part is shown in FIG. 2, but side walls are set in the outer part of the rail system. The purpose of this framework 206 is to reinforce the rail system when firing, as the magnetic fields push the rails 200-201 apart one from the other. The material used for this framework 206 can be aramid fibers, carbon fibers, or other high-performance fibers available in the market to construct solid and robust pressure vessels.

Figure 3:
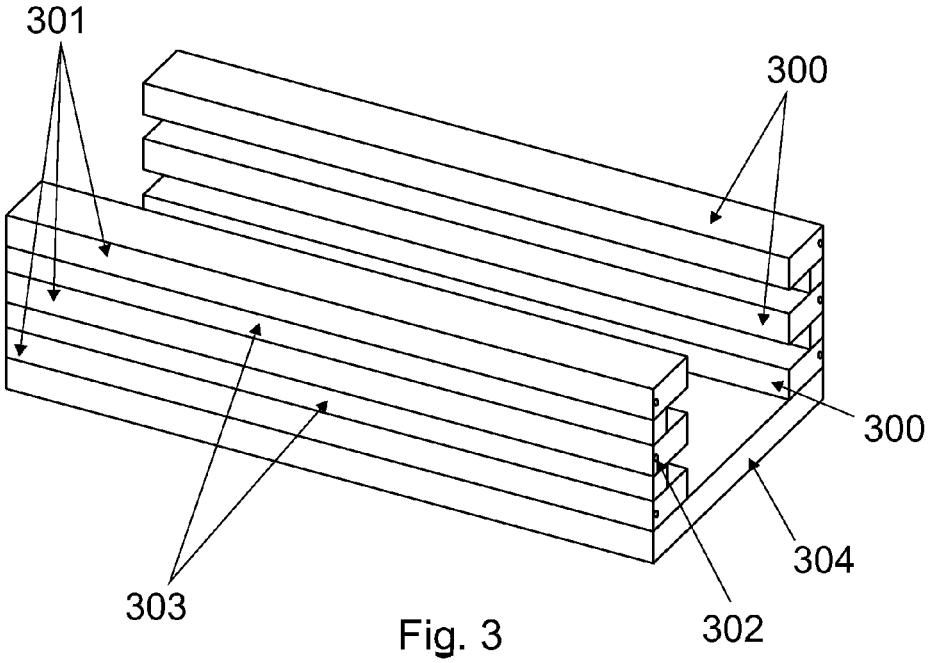
FIG. 3: It is an assembly of graphene rails in an open environment.

FIG. 3 is an assembly of open multiple graphene rails. As in the case of FIG. 2, positive graphene rails 300 receive the high current from one or more generators (not shown in FIG. 3) and conduct it towards the negative rails 301 through the armature (not shown in FIG. 3). Both positive 300 and negative 301 graphene rails have a cooling system 302 used to cool down the heat generated by the firing of the EMS. The rails 300-301 are isolated from each other by a compound 303 of those available in the market, able both to tolerate the pressures generated by the firing and to insulate them electrically. This type of compound 303 can be of the same material as the one used to isolate 205 the copper rails with the graphene layer 200-201. The whole is set inside a framework 304 similar to the one described above in FIG. 2.

Figure 4:
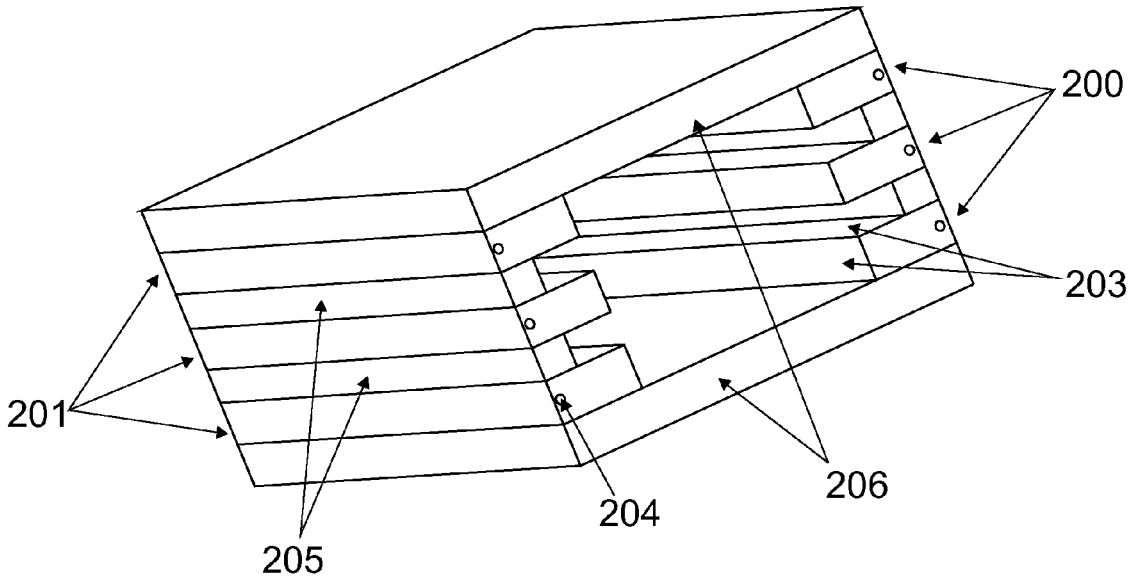
FIG. 4: It is an assembly of copper rails with graphene's protective layer in a closed environment.

FIG. 4 is an assembly of copper rails 200-201 with graphene's protective layer 203 in a closed environment. The framework 206 used covers all the structure, making a bore of rectangular structure inside which the armature (not shown) slides when fired. As the pressures generated are high, the framework must be of high-performance in order to sustain the stress generated when firing.

Figure 5:
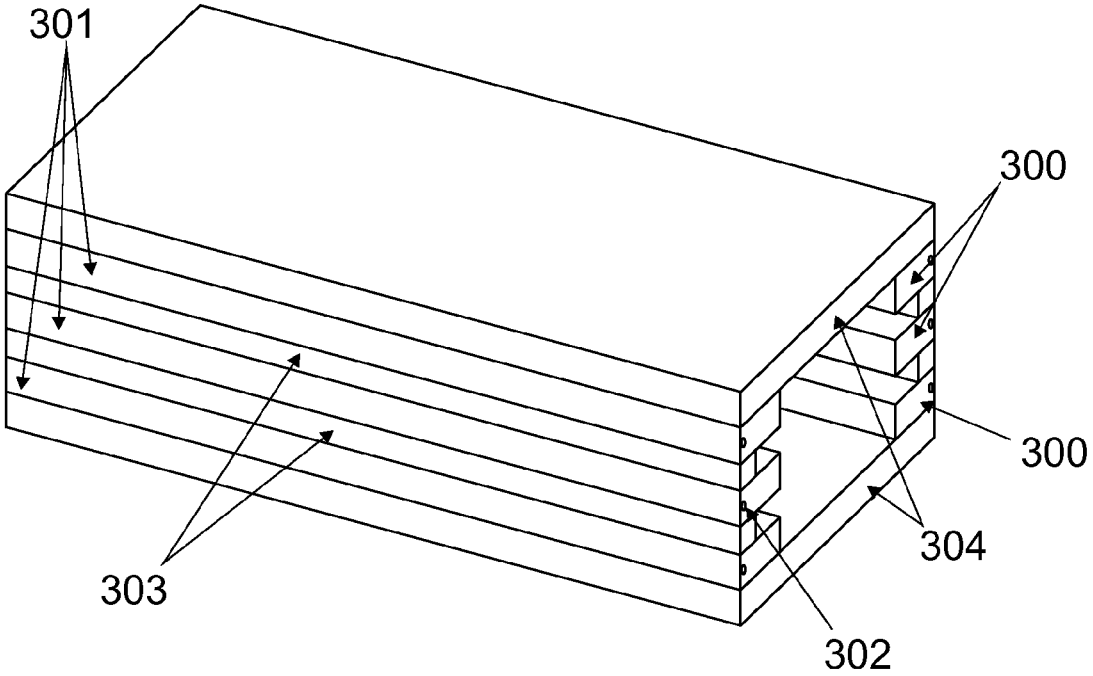
FIG. 5: It is an assembly of graphene rails in a closed environment.

FIG. 5 is an assembly of graphene rails in a closed environment with a framework 304 able to sustain the pressures generated. The work of this assembly is similar to that described previously, with the rails 300 and 301 this last one not shown) connected to the generator 103 (not shown) and an armature (not shown) sliding through the rails 300-301.

Figure 6:
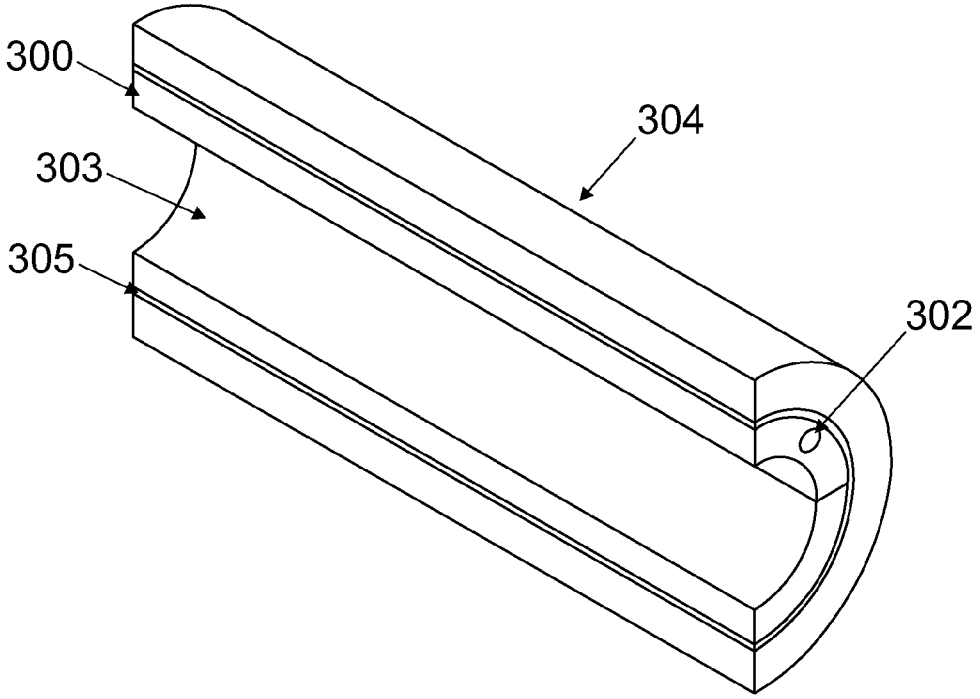
FIG. 6: It is a cut of the assembly of a couple of graphene rails in a round bore.

FIG. 6 is an assembly of a pair of graphene rails 300-301 in a round closed environment with a framework 304 able to sustain the pressures generated. The work of the generator (not shown) slides the armature (not shown) through the rails 300-301. Additional layers 305 can be added, in order to improve the overall performance, as the system could need insulators, over wraps, inner seals. The barrel of such a design is preferred for applications where a payload must be fired. A cooling systems 302 can be used as showed in other configurations and an insulator 303 must be placed between each pair of consecutive rails.

Figure 7:
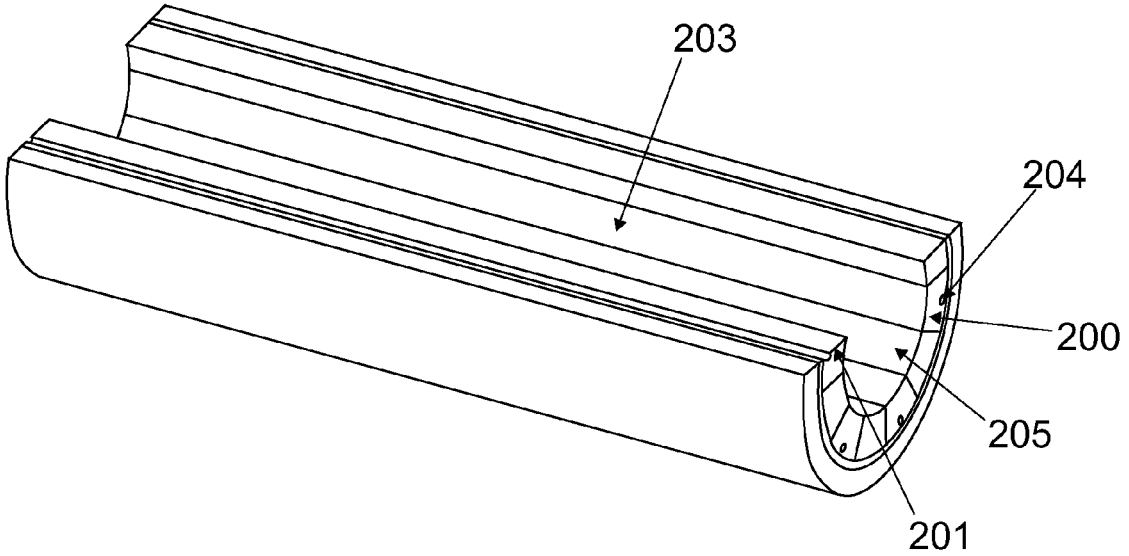
FIG. 7: It is a cut of the assembly of a multiple rail gun with copper and protective graphene layer in a round bore.

FIG. 7 is a cut of an assembly of a multitude of copper rails 200-201, where they appear coupled in pairs. The positive 200 and the negative 201 rails are protected with a graphene 203 protective cover, leveled with the insulator 205 for a smooth bore. Here only rails for 3 pairs are shown, but it is clear from the spirit of the invention that more or less pairs can be added to it without departing from the original scope.

Figure 8:
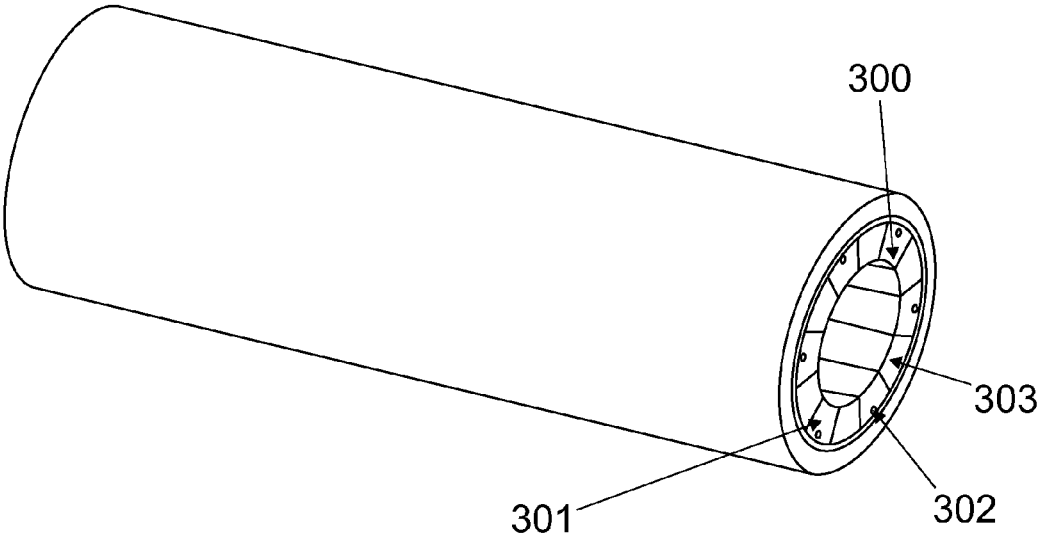
FIG. 8: It is an assembly of multiple graphene rails in a round bore.
Figure 9:
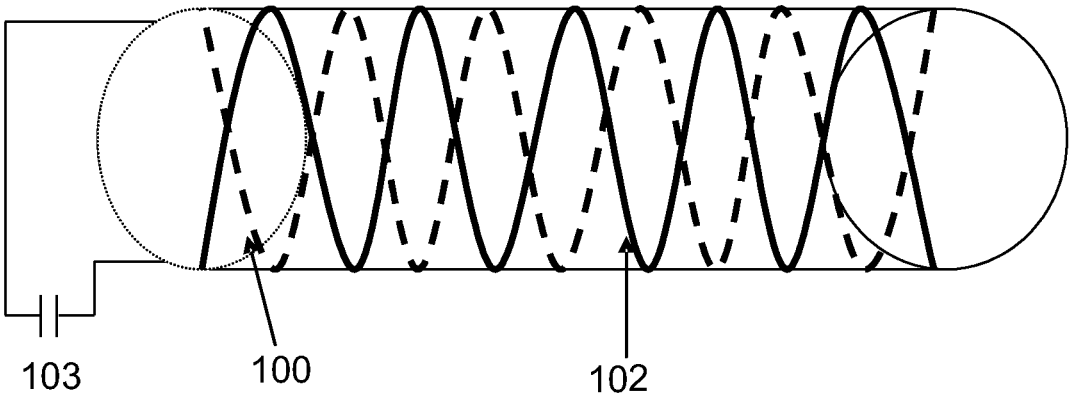
FIG. 9: It is an assembly with twisted rails.

FIG. 8 shows an assembly of multiple rails in a round bore. Positive 300 and negative 301 rails are paired opposing each other. The generators used 103 (not shown) will provide the required energy for the launch and the cooling system 302 is added. The rails are insulated from each other by a compound 303 similar to those described above FIG. 9 shows a pair of twisted rails 100 and 102 along with a generator 103. This configuration achieves a greater length in the rails and accuracy. Making helical grooves in the barrel (rifling) imparts a spin to a projectile around its long axis. This spin serves to gyroscopically stabilize the projectile, improving its aerodynamic stability.

Figure 10:
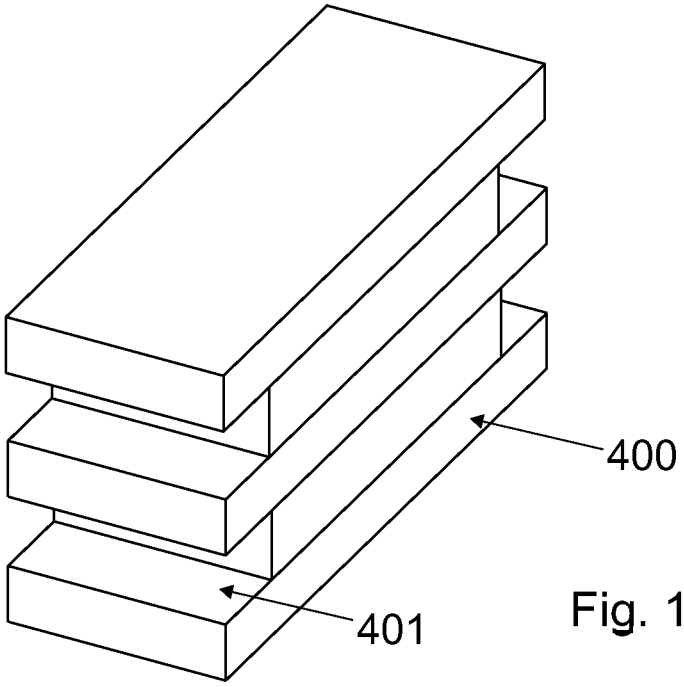
FIG. 10: It is an armature for open and closed environments EMG.

FIG. 10 shows a copper-made armature 400 for multiple rails. The faces exposed to the rails are covered with a graphene 401 protective layer for a higher performance of the overall system. This armature 400 can be used from assemblies as those showed in FIGS. 2, 3, 4 and 5 and will be part of the payload fired as a sabot or as integral part of the projectile itself depending on the applications.

Figure 11:
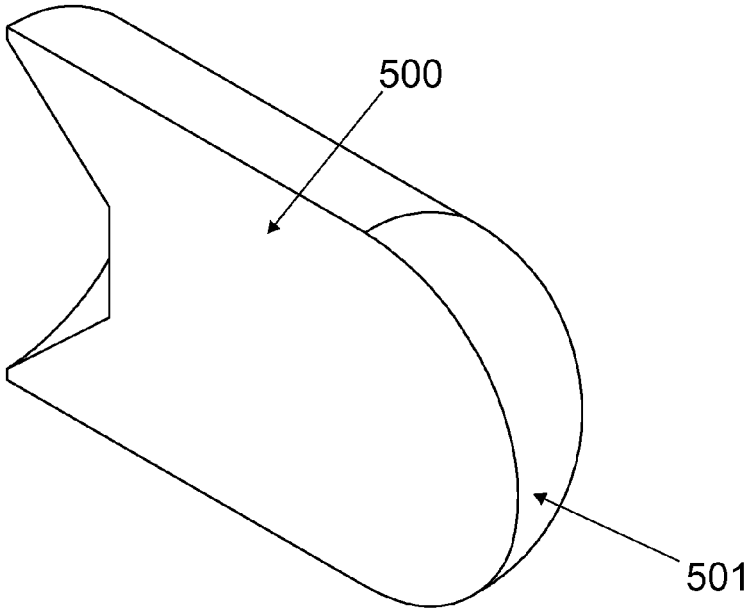
FIG. 11: It is an armature of cylindrical round head shape with a back chevron part and protective graphene layer.

FIG. 11 is a cut of a schematic view of a round shape armature 500 ended in a chevron shape. The armature 500 is covered by a graphene 501 protective layer.

Figure 12:
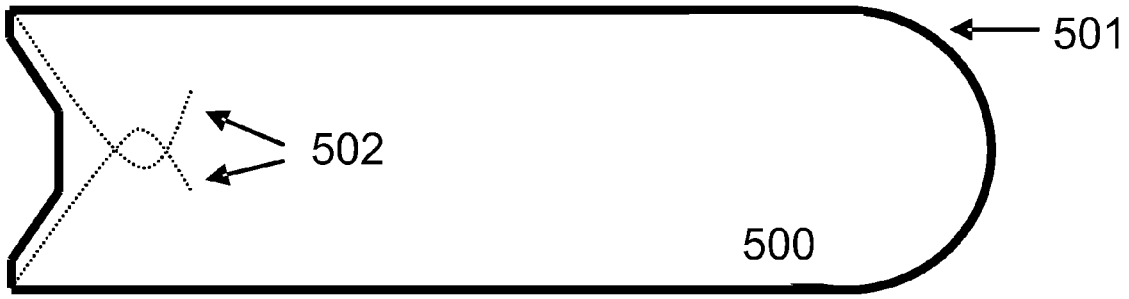
FIG. 12: It is an armature of cylindrical round head shape with a back chevron part and protective graphene layer where the inner helical magnetic shielding is shown.

FIG. 12: It is an armature 500 of cylindrical round head shape with a back chevron part and protective graphene layer 501 where the magnetic shielding is shown. In the chevron shaped part, layers of magnetic shielding 502 can be added as a helical structure to avoid interferences in the electronics inside the payload as explained above.

The invention claimed is:

1. A barrel for an electromagnetic projectile launching system, wherein the barrel comprises at least one pair of parallel spaced apart conductor rails, each rail having an end connectable to a different pole of an electric generator, the pair of rails being isolated to each other, wherein the rails are completely made of graphene.

2. The barrel of claim 1, wherein the layer is formed in internal faces of the rails inside a bore.

3. The barrel of claim 1, wherein the rails are twisted.

4. The barrel of claim 3, wherein it comprises a pitch to create a DNA-like structure.

5. The barrel of claim 1, wherein the rails comprise a cooling system embedded therein.

6. The barrel of claim 1, wherein the pair of rails are isolated to each other with an insulator.

7. The barrel of claim 6, wherein the insulator comprises fiberglass or S Glass.

8. The barrel of claim 2, wherein the form of the bore is quadrangular, circular, elliptical, octagonal or hexagonal.

9. The barrel of claim 1, wherein it comprises an armature having the sides in contact with the rails.

10. An electromagnetic projectile adapted to be fit the barrel of claim 1, wherein the projectile is covered with a protective graphene layer.

11. The projectile of claim 10, wherein the shape is quadrangular, circular, elliptical, octagonal or hexagonal.

12. The projectile of claim 11, wherein it comprises a magnetic shielding.

* * * * *